US010039396B1

(12) United States Patent
Bruno

(10) Patent No.: US 10,039,396 B1
(45) Date of Patent: Aug. 7, 2018

(54) SLEEPING PILLOWS AND METHODS OF MAKING SLEEPING PILLOWS HAVING DOUBLE INSERTS

(71) Applicant: Comfort Revolution, LLC, West Long Branch, NJ (US)

(72) Inventor: Thomas Bruno, Ocean Township, NJ (US)

(73) Assignee: Comfort Revolution, LLC, West Long Branch, NJ (US)

( * ) Notice: Subject to any disclaimer, the term of this patent is extended or adjusted under 35 U.S.C. 154(b) by 0 days.

(21) Appl. No.: 15/823,923

(22) Filed: Nov. 28, 2017

(51) Int. Cl.
*A47G 9/10* (2006.01)
*A47C 7/38* (2006.01)

(52) U.S. Cl.
CPC ..... *A47G 9/1036* (2013.01); *A47C 7/38* (2013.01); *A47G 2009/1018* (2013.01)

(58) Field of Classification Search
CPC ..... A47G 9/10; A47G 2009/1018; A47G 9/1036; A47C 7/38; A47C 7/383; A47C 27/00; A47C 27/085; A47C 27/14; A47C 27/15
USPC ..... 5/636, 639, 640, 644, 645, 654, 655.5, 5/909
See application file for complete search history.

(56) References Cited

U.S. PATENT DOCUMENTS 2,898,975 A * 8/1959 Wagner ..... A47C 27/144 267/145
3,064,279 A * 11/1962 Finkle ..... A47C 27/144 297/DIG. 1
3,242,511 A * 3/1966 Fultz et al. ..... A47C 27/081 5/490
4,021,871 A * 5/1977 Wortman ..... A47C 27/00 428/74
4,574,411 A * 3/1986 Yagi ..... A47C 21/046 5/421
4,756,035 A * 7/1988 Beier ..... A47G 9/1081 5/640
5,121,515 A * 6/1992 Hudson ..... B68G 1/00 5/502
5,231,720 A * 8/1993 Benoff ..... A47C 27/081 5/638
5,588,168 A * 12/1996 Byrne ..... A47G 9/10 5/636
6,988,286 B2 * 1/2006 Schecter ..... A47G 9/10 5/645
8,245,339 B2 * 8/2012 Murray ..... A47G 9/10 5/657
8,307,482 B2 * 11/2012 Gladney ..... A47C 27/148 5/655.5
8,512,854 B2 * 8/2013 Fox ..... A43B 1/0072 428/316.6

(Continued)

*Primary Examiner* — Robert G Santos
(74) *Attorney, Agent, or Firm* — Doherty IP Law Group LLC

(57) ABSTRACT

A method of making a pillow includes obtaining a first pillow half having an outer surface and an inner surface having a first cavity formed therein, filling the first cavity with a first filler material, obtaining a second pillow half having an outer surface and an inner surface having a second cavity formed therein, and filling the second cavity with a second filler material. The method includes, after the filling steps, juxtaposing the inner surface of the first pillow half with the inner surface of the second pillow half and joining the first and second pillow halves together to form a pillow.

18 Claims, 4 Drawing Sheets

(56) References Cited

U.S. PATENT DOCUMENTS

| | | | | |
|---|---|---|---|---|
| 9,247,836 | B2 * | 2/2016 | DuPre | A47G 9/1045 |
| 2004/0019972 | A1 * | 2/2004 | Schecter | A47G 9/10 5/645 |
| 2007/0226911 | A1 * | 10/2007 | Gladney | A47C 27/148 5/691 |
| 2008/0235877 | A1 * | 10/2008 | Murray | A47G 9/10 5/640 |
| 2009/0142551 | A1 * | 6/2009 | Fox | A43B 1/0072 428/158 |
| 2010/0005595 | A1 * | 1/2010 | Gladney | A47C 27/148 5/691 |
| 2012/0079661 | A1 * | 4/2012 | Chen | B68G 5/00 5/655.5 |
| 2012/0180225 | A1 * | 7/2012 | Gladney | A47C 27/148 5/740 |
| 2013/0263377 | A1 * | 10/2013 | Wootten, Jr. | A47C 23/00 5/640 |
| 2014/0053341 | A1 * | 2/2014 | Parvin | B32B 3/28 5/740 |
| 2014/0096324 | A1 * | 4/2014 | LaFlamme | A47C 27/15 5/691 |
| 2014/0123396 | A1 * | 5/2014 | Fox | A43B 1/0072 5/691 |
| 2014/0141233 | A1 | 5/2014 | Crawford et al. | |
| 2014/0196214 | A1 * | 7/2014 | DuPre | A47G 9/1045 5/644 |
| 2016/0368185 | A1 | 12/2016 | Fux et al. | |

* cited by examiner

SLEEPING PILLOWS AND METHODS OF MAKING SLEEPING PILLOWS HAVING DOUBLE INSERTS

BACKGROUND OF THE INVENTION

Field of the Invention

The present patent application is generally related to sleep products, and is more particularly related to sleeping pillows.

Description of the Related Art

Products having cooling gel layers are effective at providing a cooling effect on the skin. FIG. 5 shows a foam pillow 114 having a continuous cooling gel layer 116 provided over a top surface of the pillow. Foam is not a good conductor of heat, and the gel layer is provided to conduct heat away from the individual's skin contacting the gel layer. FIG. 6 shows a foam mattress 118 having a continuous cooling gel layer 120 over the top surface of the foam mattress. The gel layer provides a cooling sensation due to heat conduction.

The cooling gel layers shown in FIGS. 5 and 6 are effective for providing a cooling effect for an individual using a pillow and a mattress because the gel material conducts heat away from the body to cool the body. One drawback of continuous cooling gel layers, however, is that they are impermeable and do not breathe. As a result, air is not able to pass through the nonpermeable, continuous gel layers, which may minimize the cooling effect achieved by using the gel layer.

Some products have one or more gel layers that cover less than 100% of a surface. In these products, the gel layers may be patches that cover certain areas of the surface. The gel layers may be spaced from one another over the surface. Although air may pass through some sections of the surface, the areas covered by the gel patches or gel layers are nonpermeable so that air is not able to pass through the gel layers.

There have been some efforts directed to providing sleeping products having both cooling gels and permeability through the cooling gel treated areas. For example, commonly assigned United States Patent Application Publication No. 2016/0368185 to Fux et al., the disclosure of which is hereby incorporated by reference herein, discloses methods, systems and devices for treating natural and synthetic fibers with cooling gels. In one embodiment, the fibers are coated individually so that the material remains porous and allows air to pass therethrough. In one embodiment, US 2016/0368185 discloses methods that avoid completely coating a surface of fiber based material or a foam layer with a cooling gel, which will render the surface non-permeable and will not allow air to pass therethrough.

In spite of the above advances, there is a continuing need for products such as pillows, mattresses and mattress toppers that use cooling gel or filler material infused with cooling gel to achieve a cooling effect.

SUMMARY OF THE INVENTION

In one embodiment, a method of making a pillow includes obtaining a first pillow half having an outer surface and an inner surface having a first cavity formed therein, and filling the first cavity with a first filler material. In one embodiment, the method includes obtaining a second pillow half having an outer surface and an inner surface having a second cavity formed therein, and filling the second cavity with a second filler material. In one embodiment, after the filling steps, the inner surface of the first pillow half is juxtaposed with the inner surface of the second pillow half and the first and second pillow halves are joined together to form a pillow.

In one embodiment, the first and second pillow halves are made of foam such as memory foam. In one embodiment, at least one of the first and second pillow halves includes a cooling gel, such as a cooling gel impregnated into the foam.

In one embodiment, the first and second filler materials may include cooling gels, cooling gel layers, shredded foam, chopped foam, shredded latex, chopped latex, fibers, and/or polyester fibers. The foam, latex and fibers may be treated with a cooling gel material. In one embodiment, the first and second filler material may be a molded or cut foam core, a molded or cut memory foam core, a molded or cut polyurethane foam core, a molded or cut polyurethane memory foam core In one embodiment, the joining step includes adhering the inner surfaces of the first and second pillow halves together.

In one embodiment, the joining step includes adhering an outer surface of the first filler material to an outer surface of a second filler material.

In one embodiment, the filling the first cavity step includes depositing a flowable cooling gel into the first cavity and curing the cooling gel to provide a cured cooling gel layer having an outer surface that is parallel to and aligned with the inner surface of the first pillow half.

In one embodiment, the filling the second cavity step includes depositing a flowable cooling gel into the second cavity and curing the cooling gel to provide a second cured cooling gel layer having an outer surface that is parallel to and aligned with the inner surface of the second pillow half.

In one embodiment, the method includes adhering the inner surface of the first pillow half to the inner surface of the second pillow half.

In one embodiment, the method includes adhering the outer surface of the first cured cooling gel layer to the outer surface of the second cured cooling gel layer.

In one embodiment, a method of making a pillow includes forming a first memory foam pillow half having an outer surface and an inner surface having a first cavity formed therein, depositing a flowable cooling gel into the first cavity, and curing the cooling gel to provide a cured cooling gel layer having an outer surface that is parallel to and aligned with the inner surface of the first memory foam pillow half.

In one embodiment, the method includes forming a second memory foam pillow half having an outer surface and an inner surface having a second cavity formed therein, depositing a flowable cooling gel into the second cavity, and curing the cooling gel to provide a second cured cooling gel layer having an outer surface that is parallel to and aligned with the inner surface of the second pillow half.

In one embodiment, after the depositing steps, the inner surface of the first memory foam pillow half is preferably juxtaposed with the inner surface of the second memory foam pillow half for joining the first and second memory foam pillow halves together to form a pillow.

In one embodiment, the joining step includes adhering the inner surface of the first pillow half to the inner surface of the second pillow half. In one embodiment, the joining step includes adhering the outer surface of the first cured cooling gel layer to the outer surface of the second cured cooling gel layer.

In one embodiment, at least one of the first and second memory foam pillow halves is infused with cooling gel.

In one embodiment, the method includes using an adhesive for joining the first and second memory foam pillow halves together.

In one embodiment, a pillow includes a first memory foam pillow half having an outer surface and an inner surface having a first cavity formed therein, and a first cooling gel layer disposed within the first cavity, the first cooling gel layer having an outer surface that is parallel to and aligned with the inner surface of the first memory foam pillow half. In one embodiment, the pillow includes a second memory foam pillow half having an outer surface and an inner surface having a second cavity formed therein, and a second cooling gel layer disposed within the second cavity, the second cooling gel layer having an outer surface that is parallel to and aligned with the inner surface of the second memory foam pillow half.

In one embodiment, the inner surfaces of the first and second memory foam pillow halves are joined together to form a pillow.

In one embodiment, the inner surfaces of the first and second memory foam pillow halves are adhered together.

In one embodiment, the outer surfaces of the first and second cooling gel layers are adhered together.

In one embodiment, an adhesive joins the first and second pillow halves together.

In one embodiment, the filler material for a pillow may include natural and synthetic fibers that are treated with cooling gels. In one embodiment, the fibers are coated individually so that the material remains porous and allows air to pass therethrough. In one embodiment, the present patent application teaches avoiding completely coating a surface of fiber based material or a foam layer with a cooling gel, which will render the surface non-permeable and will not allow air to pass therethrough.

These and other preferred embodiments of the present patent application will be described in more detail below.

DETAILED DESCRIPTION OF PREFERRED EMBODIMENTS

Figure 1:
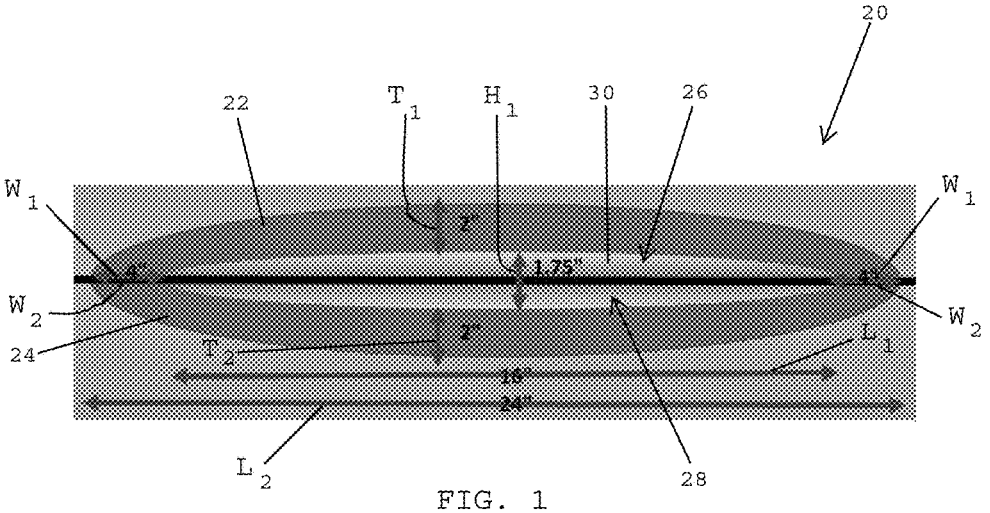
FIG. 1 shows a cross-sectional view of a pillow having first and second pillow halves, a central cavity located between the first and second pillows halves, and a filler material disposed within the central cavity, in accordance with one embodiment of the present patent application.

Referring to FIG. 1, in one embodiment, a pillow 20 preferably includes a first pillow half 22 and a second pillow half 24 that are adapted to be joined together to form a unitary pillow structure. In one embodiment, an inner face of the first pillow half 22 has a first cavity 26 formed therein. Similarly, the second pillow half 26 has an inner face with a second cavity 28 formed therein. The cavities may be molded or formed by removing material from the inner faces of the two pillow halves. In one embodiment, prior to being assembled together, the first and second pillow halves 22, 24 are juxtaposed with one another so that the first and second cavities 26, 28 are aligned with one.

In one embodiment, opposing inner faces of the two pillows halves are adhered together. In one embodiment, opposing peripheral edges of the two pillows halves are aligned with one another and adhered together so that the two cavities in the respective first and second pillow halves form a central cavity that may be filled with a filler material such as a cooling gel, shredded foam, shredded latex, polyester fiber, and other well-known filler materials used for sleeping products.

In one embodiment, prior to assembling the first and second pillow halves 22, 24 together, the respective first and second cavities 26, 28 may be filled with a filler material, such as cooling gel, shredded foam, shredded latex, and/or polyester fiber. In one embodiment, the filler material may be impregnated with a cooling gel to provide a cooling effect for a user of the pillow 20.

In one embodiment, the first and second pillow halves 22, 24 are made of foam, such as memory foam. In one embodiment, the first and second pillow halves 22, 24 are molded so that the first and second cavities 26, 28 are pre-formed (e.g., molded) into the inner faces of the first and second pillow halves. In one embodiment, material may be removed from the inner faces of the first and second pillow halves 22, 24 to form the respective first and second cavities 26, 28.

In one embodiment, after the first and second pillow halves 22, 24 are joined together, the combination of the first and second cavities 26, 28 define a central cavity 30 having a height $H_1$ of about 0.25-3 inches, more preferably about 0.50-1.75 inches, and even more preferably about 1.00 inch, and a length $L_1$ of about 16 inches. In one embodiment, the first pillow half 22 has a wall thickness $T_1$ of about 0.25-3.75 inches and more preferably about 2.00 inches and the second pillow half 24 has a wall thickness $T_2$ of about 0.25-3.75 inches and more preferably about 2.00 inches. In one embodiment, the perimeter edge of the first pillow half 22 has a width $W_1$ of about 4 inches. The width $W_1$ is defined as the distance between the outer surface of the wall of the first pillow half 22 and the inner surface of the wall of the first pillow half 22, which defines the first cavity 26. In one embodiment, the outer peripheral edge of the second pillow half 24 has a width $W_2$ of about 4 inches which matches the width $W_1$ of the first pillow half 22.

In one embodiment, the pillow 20 has an overall height of about 3.00-8.00 inches and more preferably about 5.75 inches.

In one embodiment, the technology disclosed herein may be incorporated into pillows having various sizes such as a standard pillow having dimensions of 20 inches×26 inches, a super standard pillow having dimensions of 20 inches×28 inches, a queen pillow having dimensions of 20 inches×30 inches, or a king pillow having dimensions of 20 inches×36 inches.

Figure 2:
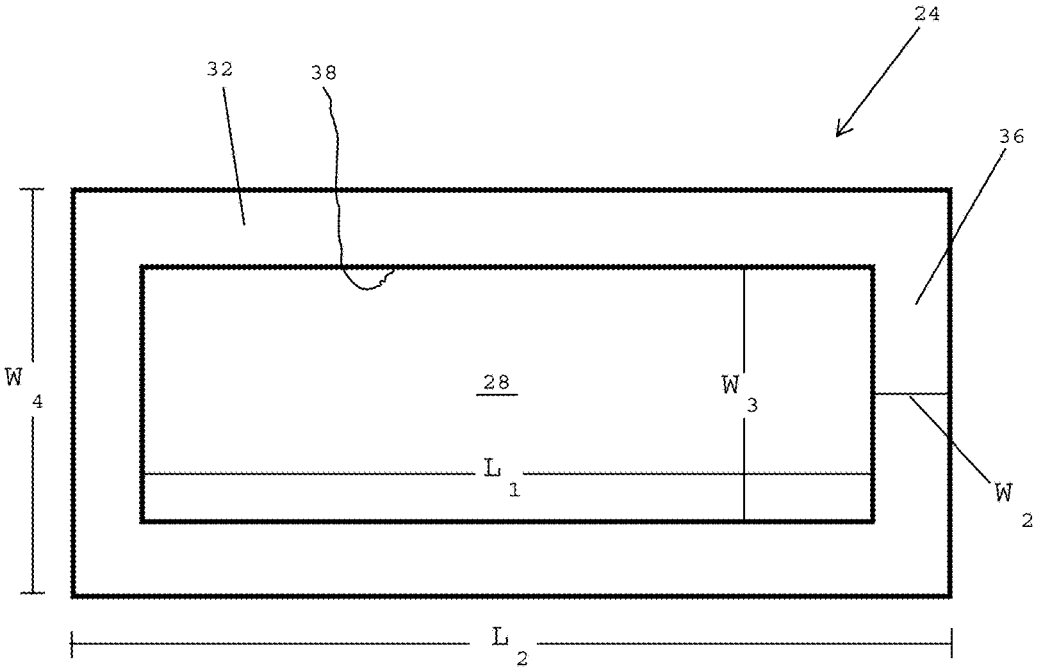
FIG. 2 shows a top plan view of a pillow half, in accordance with one embodiment of the present patent application.

Referring to FIG. 2, in one embodiment, the second pillow half 24 has an inner face 32 with a second cavity 28 formed therein. The second cavity 28 is preferably a depression that is formed in, molded and/or cored out of the inner face 32 of the second pillow half 24. In one embodiment, the second cavity 28 has a length $L_1$ of about 16 inches and a width $W_3$ of about 12 inches. The second pillow half 24 has a length $L_2$ of about 24 inches and a width $W_4$ of about 20 inches. The inner face 32 of the second pillow half 24 defines a perimeter edge 36 that extends completely around the outer perimeter 38 of the second cavity 28. In one embodiment, the perimeter edge has a width $W_2$ of about 4 inches.

Figure 3A:
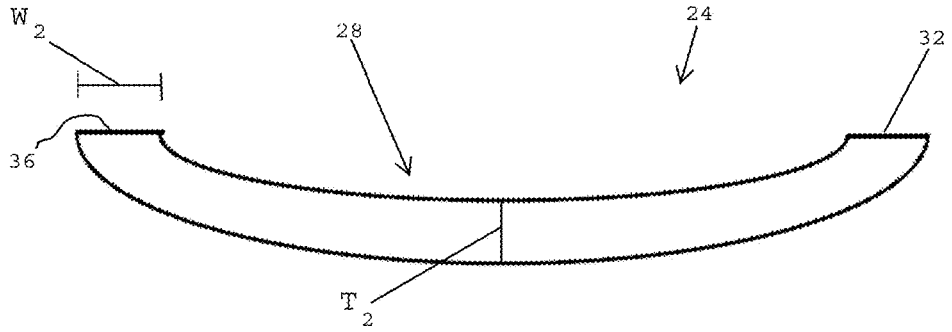
FIG. 3A shows a first stage of a method of making a pillow, in accordance with one embodiment of the present patent application.

Referring to FIG. 3A, in one embodiment, the second pillow half 24 is made of foam such as molded memory foam. In one embodiment, the second cavity 28 is molded into the inner face 32 of the second pillow half 24. In one embodiment, the second pillow half 24 has a wall thickness $T_2$ of about 2 inches (i.e., the distance between an outer surface and an inner surface defining the second cavity 28). In one embodiment, the perimeter edge 36 of the second pillow half 24 has a width $W_2$ of about four inches.

Figure 3B:
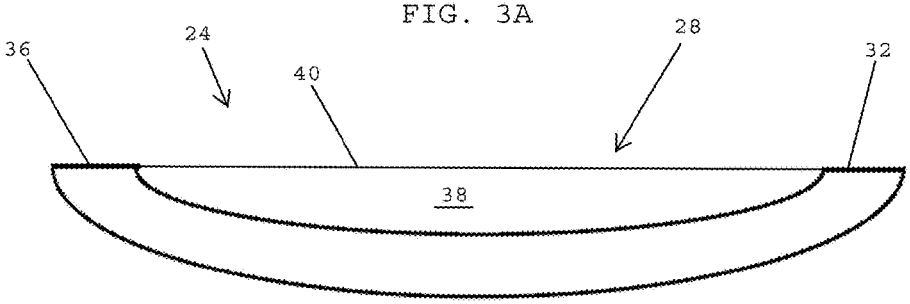
FIG. 3B shows a second stage of a method of making a pillow, in accordance with one embodiment of the present patent application.

Referring to FIGS. 3A and 3B, in one embodiment, the second cavity 28 formed in the second pillow half 24 is filled with a filler material. In one embodiment, the filler material is a cooling gel 38. The cooling gel 38 is preferably cured to provide a cooling gel layer disposed within the second cavity 28. The cooling gel layer 38 preferably has an outer surface 40 that is parallel to and aligned with the inner face 32 of the second pillow half 24. Although FIG. 3B shows the second cavity 28 being filled with a layer of cooling gel 38, in other embodiments, other filler materials may be used such as shredded foam, shredded latex, and/or polyester fiber. The filler material may be treated with a cooling gel or a phase change material to provide a cooling effect for a user. In one embodiment, a liner may be placed over the outer surface 40 of the filler material 38 to seal or secure the filler material within the second cavity 28. In one embodiment, the liner may be adhered to the inner face 32 of the second pillow half 24 at the peripheral edges 36 of the second pillow half 24.

Figure 3C:
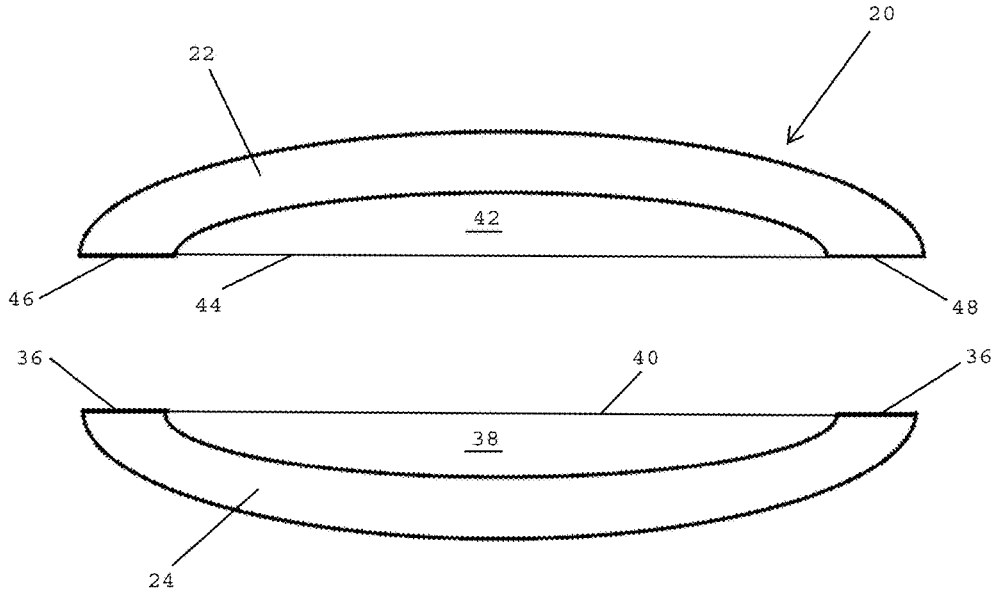
FIG. 3C shows a third stage of a method of making a pillow, in accordance with one embodiment of the present patent application.

Referring to FIG. 3C, in one embodiment, similar to the second pillow half, the first pillow half 22 is filled with a filler material such as a cooling gel layer 42 having an outer surface 44 that preferably lies parallel to and is aligned with the inner surface 46 of the first pillow half 22.

In one embodiment, the opposing inner surfaces 46, 36 of the respective first and second pillow halves 22, 24, with the respective cooling gel layers 42, 38 in the cavities, are juxtaposed with one another so that the peripheral edge 36 of the second pillow half 24 is aligned with the opposing peripheral edge 48 of the first pillow half 22. In one embodiment, an adhesive may be applied to the opposing surfaces of the peripheral edges 36, 48 and/or the opposing outer surfaces 40, 44 of the two gel layers 38, 42.

Figure 4:
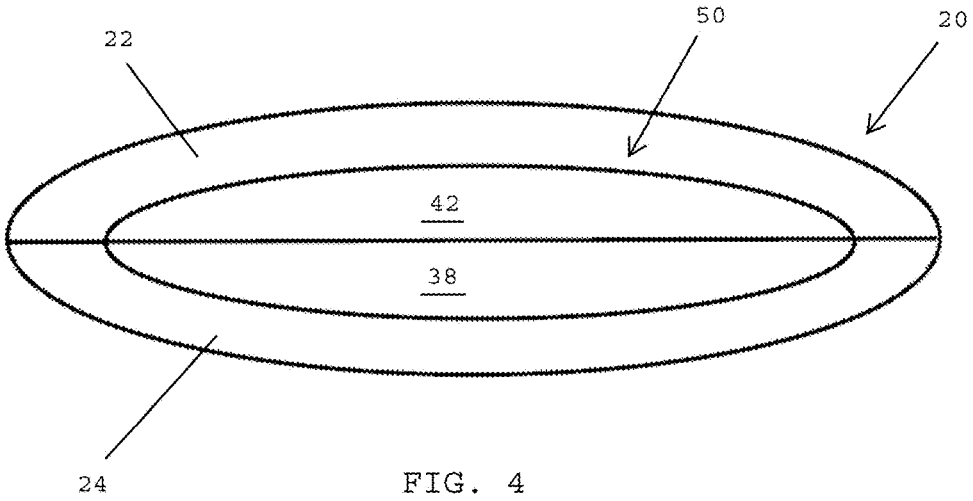
FIG. 4 shows a cross-sectional view of a pillow having first and second pillow halves, a central cavity located between the first and second pillows halves, and first and second gel layers disposed within the central cavity, in accordance with one embodiment of the present patent application.
Figure 5:
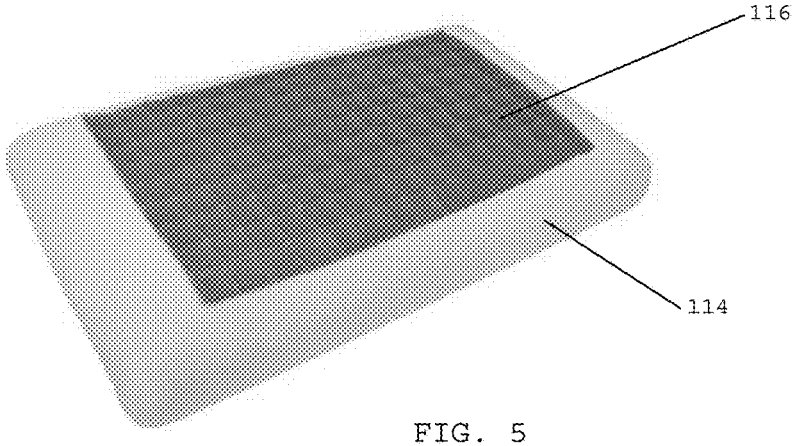
FIG. 5 PRIOR ART
FIG. 5 shows a foam pillow having a nonpermeable gel layer.
Figure 6:
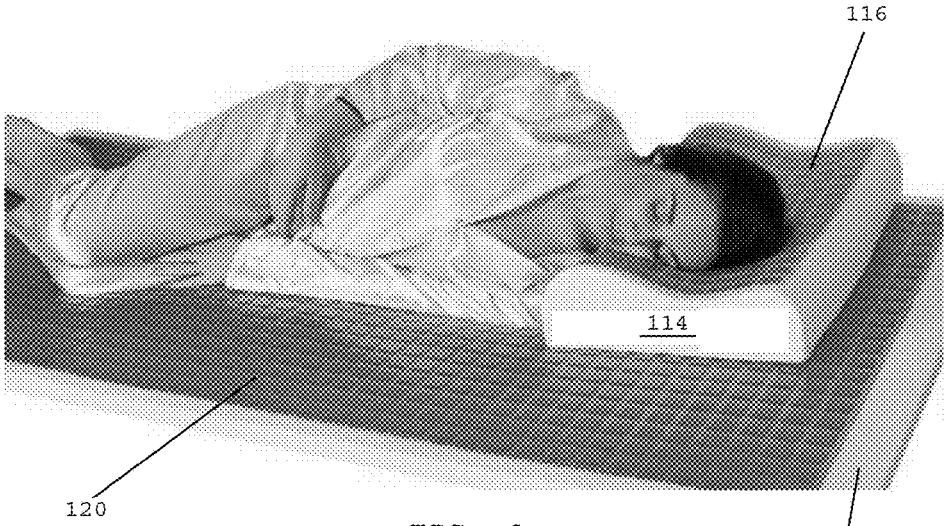
FIG. 6 PRIOR ART
FIG. 6 shows a foam mattress having a nonpermeable gel layer.

Referring to FIG. 4, in one embodiment, after an adhesive material is provided between the opposing surfaces of the first pillow half 22 and the second pillow half 24, the first and second pillow halves are joined together to form a pillow 20 having a cooling gel core 50 including a first gel layer 42 disposed within a cavity formed in the first pillow half 22 and a second cooling gel layer 38 disposed within the second cavity of the second pillow half 24. Heat and/or compression may be used for joining the first and second pillow halves together.

In one embodiment, one or more surfaces of the first and second pillow halves 22, 24 may be treated with a phase change material and/or a cooling gel material. In one embodiment, the first and second pillow halves 22, 24 are made of memory foam that is infused and/or impregnated with a cooling gel material and/or a phase change material to provide a cooling effect for a user.

In one embodiment, the filler material may be garneted fiber that is infused with a cooling gel. In one embodiment, an exposed surface of the garneted fiber is sprayed with a solution containing of cooling gel that binds to the individual fibers. The cooling gel may include a solvent, cooling gel and/or a phase change material that is atomized and sprayed onto the garneted fiber. The cooling gel may be cured, such as by using heat or by allowing the cooling gel to cure in ambient conditions. In one embodiment, the present patent application uses a cooling gel solution disclosed in US 2014/0141233 assigned to Peterson Chemical Technology, Inc., the disclosure of which is hereby incorporated by reference herein. In one embodiment, the treated garneted fiber may be exposed, interior, or both. The percentage of the garneted fiber that is treated may be between 1-100%.

In one embodiment, the cooling gel may be rolled onto the garneted fiber for infusing the individual fibers with the cooling gel. In one embodiment, the cooling gel preferably bonds to the individual fibers and does not form a continuous masking layer that would render the substrate impermeable to air passing through the substrate. In one embodiment, the present patent application seeks to maintain permeability and air flow through the fibers that have been treated with the cooling gel.

In one embodiment, 100% of the garneted fiber may be infused with the cooling gel. In other embodiments, only a portion of the garneted fiber is treated with the cooling gel. The percentage of treatment may be anywhere between 0-100%. The technology disclosed herein may include filler material that has been infused with cooling gel, and that may be incorporated into a broad range of products including bedding, mattresses, mattress toppers, pillows, sheets, bed covers, textile fabrics, clothing, sleeping bags, and slippers.

In one embodiment, the filler material may be a fiber material that is carded. In one embodiment, the fiber material is carded and then infused with a cooling gel as described above so that the individual fibers are infused with cooling gel. In one embodiment, the treated fiber material preferably remains permeable and so that air may flow through the cooling gel infused fiber material.

In one embodiment, a roller may be used for rolling cooling gel onto the filler material. The roller may be made of a broad range of materials including rubber, foam, wool, etc. The cooling gel may be cured using heat and air to accelerate curing or may be cured using ambient air.

In one embodiment, the first and second pillow halves may be coated with a cooling gel. In one embodiment, 1-100% of the exposed surface area of the first and second pillow halves is coated with a cooling gel. The cooling gel may be provided on the foam layers using spraying or rolling techniques. The filler material inserted into the cavities of the first and second pillow halves may be infused with a cooling gel as described above. The percentage of the filler material that is infused with cooling gel may be between 0-100%. In one embodiment, the filler material is a fiber material that may be garneted fiber, air blown fiber, or carded fiber. In one embodiment, the filler material may be chopped foam, chopped latex, fibrous material, and/or other well known filling materials.

In one embodiment, a cooling gel is preferably applied to the first and second pillow halves or the filler material by spraying cooling gel onto the foam layer. Spraying an atomized cooling gel enables the gel to completely cover the exposed surfaces of pillow halves. In one embodiment, only certain regions of the pillow halves are covered by the cooling gel and other areas of the pillow halves remain untreated.

In one embodiment, the pillow halves are made of foam that incorporates surface modification technology (SMT) provided by FoamEx, also known as FXI of Media, Pennsylvania.

In one embodiment, the cooling gel may be rolled or brushed onto the exposed surfaces of the first and second pillow halves.

In one embodiment, the cooling gel has a unique composition including a mold release element and a phase change material (PCM) element that enables the cooling gel to function as both a mold release agent and a coating for a foam part that provides a cooling effect. In one embodiment, the dual function cooling gel is sprayed, brushed, rolled, and/or deposited onto a mold surface. Next, a foam is introduced into the mold. The foam rises, preferably while applying heat to the cooling gel and foam composition. The foam part may then be removed from the mold. The cooling gel has a composition that facilitates removal of the foam part from the mold. After the foam part has been removed from the mold, the cooling gel remains on the outer surface of the foam part to impart a cooling effect for a user.

In one embodiment, the mold release cooling gel may be used with memory foam, reactive polyurethanes, and any of the fiber materials disclosed herein.

In one embodiment, the cooling gel composition may be sprayed, rolled, brushed, and/or deposited onto a previously made foam part.

In one embodiment, the cooling gel may be used as a coating that imparts thermal managing properties to a foam surface using a thermoplastic elastomer that has a high affinity for certain paraffin oils (aliphatic hydrocarbons) that are dissolved in a specialized solvent that quickly flashes away once applied in a thick film. In one preferred embodiment, the cooling gel is a hydrotreated light distillate with mainly 9 to 16 carbons and a viscosity under 10 cP.

In one preferred embodiment, the cooling gel composition comprises:

Septon 4055 2.5%
Methyl Amyl Ketone (MAK) 21.1%
Turpenoid Oil 58.4%
Microencapsulated Phase Change Material (PCM) 18.0%
Total 100%

In certain preferred embodiments, the solvents used to make the cooling gel may include but are not limited to xylene, n-butyl acetate, methyl acetate, methyl amyl ketone, mineral spirits, and/or iso butyl isobutyrate.

In one embodiment, various blends of solvents are possible to optimize the processing and flash rate of the coating, as well as the odor.

In one embodiment, various tackifiers, plasticizers, oils, lubricants, adhesion promoters, and/or surfactants may be incorporated into the cooling gel to modify the properties of the coating.

In one embodiment, different forms of microencapsulated phase change materials (micro PCM's) may be used to adjust the cooling sensation.

In one embodiment, changes to the PCM material may include but are not limited to changing the melting point of the core material.

In one embodiment, thermoplastics suitable for use may include tri-block co-polymers such as SEBS (styrene block-ethylene-butylene block-styrene block), SEEPS (styrene block-ethylene-ethylene-propylene-styrene block), SBS (styrene block-butadiene block-styrene block), or SEEBS (styrene block-ethylene-ethylene-butylene block-styrene block).

In one embodiment, the cooling gel coating may be applied to the following components: 1) Flat or contoured sleep surfaces comprised of polymeric foam material, such as polyurethane foam; 2) Polyester, nylon, polyethylene, polypropylene, melamine, or other forms of fiber; 3) Molded or contoured pillows of various shapes.

The viscosity of the cooling gel coating may be adjusted for use in the following applications: 1) As a sprayable coating; 2) As a roll coat; 3) As a "dip and nip" applied coating.

In one embodiment, the coating may be used as both a mold release and as a cooling gel that remains on the surface of the foam. In one embodiment, the cooling gel coating is sprayed into a mold prior to introducing a foaming mixture that produces a composite of polyurethane foam and the coating. The cooling gel coating has a composition that enables it to serve two functions: 1) a mold release coating; and 2) a cooling gel coating that remains on the surface of the foam after the foam has been removed from the mold to provide a cooling effect.

The cooling gel coating disclosed herein provides numerous advantages over the prior art coatings including the physical properties of the resultant coating, durability, and washability.

Although the present invention is not limited by any particular theory of operation, it is believed that these benefits are due to the ability to swell the high physical property tri-block copolymer thermoplastic material with the uniquely selected parrafin oil.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A method of making a pillow comprising:

obtaining a first pillow half having an outer surface and an inner surface having a first cavity formed therein;

filling said first cavity with a first filler material;

obtaining a second pillow half having an outer surface and an inner surface having a second cavity formed therein;

filling said second cavity with a second filler material;

after the filling steps, juxtaposing said inner surface of said first pillow half with said inner surface of said second pillow half and joining said first and second pillow halves together to form a pillow, wherein said joining step comprises adhering an outer surface of said first filler material to an outer surface of said second filler material.

2. The method as claimed in claim 1, wherein said first and second pillow halves comprise foam.

3. The method as claimed in claim 2, wherein at least one of said first and second pillow halves comprises a cooling gel.

4. The method as claimed in claim 1, wherein said first and second filler materials are selected from the group consisting cooling gel, cooling gel layers, shredded foam, chopped foam, shredded latex, chopped latex, fibers, polyester fibers, molded or cut foam layers, molded or cut foam cores, molded or cut memory foam layers, molded or cut memory foam cores, molded or cut polyurethane foam layers, and molded or cut polyurethane foam cores.

5. The method as claimed in claim 1, wherein the joining step comprises adhering said inner surfaces of said first and second pillow halves together.

6. The method as claimed in claim 1, wherein the filling said first cavity step comprises depositing a flowable cooling gel into said first cavity and curing said cooling gel to provide a cured cooling gel layer having an outer surface that is parallel to and aligned with said inner surface of said first pillow half.

7. The method as claimed in claim 6, wherein the filling said second cavity step comprises depositing a flowable cooling gel into said second cavity and curing said cooling gel to provide a second cured cooling gel layer having an outer surface that is parallel to and aligned with said inner surface of said second pillow half.

8. The method as claimed in claim 7, further comprising adhering said inner surface of said first pillow half to said inner surface of said second pillow half.

9. The method as claimed in claim 8, further comprising adhering said outer surface of said first cured cooling gel layer to said outer surface of said second cured cooling gel layer.

10. A method of making a pillow comprising:

forming a first memory foam pillow half having an outer surface and an inner surface having a first cavity formed therein;

depositing a flowable cooling gel into said first cavity and curing said cooling gel to provide a cured cooling gel layer having an outer surface that is parallel to and aligned with said inner surface of said first memory foam pillow half;

forming a second memory foam pillow half having an outer surface and an inner surface having a second cavity formed therein;

depositing a flowable cooling gel into said second cavity and curing said cooling gel to provide a second cured cooling gel layer having an outer surface that is parallel to and aligned with said inner surface of said second pillow half;

after the depositing steps, juxtaposing said inner surface of said first memory foam pillow half with said inner surface of said second memory foam pillow having and joining said first and second memory foam pillow halves together to form a pillow.

11. The method as claimed in claim 10, wherein the joining step comprises adhering said inner surface of said first pillow half to said inner surface of said second pillow half.

12. The method as claimed in claim 11, wherein the joining step further comprises adhering said outer surface of said first cured cooling gel layer to said outer surface of said second cured cooling gel layer.

13. The method as claimed in claim 10, wherein at least one of said first and second memory foam pillow halves is infused with cooling gel.

14. The method as claimed in claim 10, further comprising using an adhesive for joining said first and second memory foam pillow halves together.

15. A pillow comprising:

a first memory foam pillow half having an outer surface and an inner surface having a first cavity formed therein;

a first cooling gel layer disposed within said first cavity, said first cooling gel layer having an outer surface that is parallel to and aligned with said inner surface of said first memory foam pillow half;

a second memory foam pillow half having an outer surface and an inner surface having a second cavity formed therein;

a second cooling gel layer disposed within said second cavity, said second cooling gel layer having an outer surface that is parallel to and aligned with said inner surface of said second memory foam pillow half, wherein said inner surfaces of said first and second memory foam pillow halves are joined together to form a pillow.

16. The pillow as claimed in claim 15, wherein said inner surface of said first and second memory foam pillow halves are adhered together.

17. The pillow as claimed in claim 16, wherein said outer surfaces of said first and second cooling gel layers are adhered together.

18. The pillow as claimed in claim 15, further comprising an adhesive that joins said first and second pillow halves together.

* * * * *